US005197394A

United States Patent [19]

Schmidt

[11] Patent Number: 5,197,394

[45] Date of Patent: Mar. 30, 1993

[54] GARDEN UMBRELLA

[76] Inventor: Brigitta C. Schmidt, Kurfurstenstr. 14, 6000 Frankfurt/Main 90, Fed. Rep. of Germany

[21] Appl. No.: 624,103

[22] Filed: Dec. 10, 1990

[30] Foreign Application Priority Data

Dec. 9, 1989 [DE] Fed. Rep. of Germany ..... 89145127[U]

[51] Int. Cl.[5] ..... A47B 35/00

[52] U.S. Cl. ..... 108/50; 108/150; 108/128

[58] Field of Search ..... 108/50, 14, 25, 26, 108/128, 150, 160; 248/158, 186, 166, 168, 434, 150; 135/98

[56] References Cited

U.S. PATENT DOCUMENTS

| | | | |
|---|---|---|---|
| 1,421,779 | 7/1922 | Heerling | 108/128 X |
| 1,571,129 | 1/1926 | Luckhoff | 108/128 X |
| 2,454,202 | 11/1948 | Pierik | 108/50 X |
| 2,604,932 | 7/1952 | Leggett | 108/128 X |
| 2,805,109 | 9/1957 | Kopmar | 108/50 |
| 2,826,469 | 3/1958 | Grant | 108/50 X |
| 3,295,473 | 1/1967 | Wentworth | 108/50 X |
| 4,461,220 | 7/1984 | Wetzel | 248/156 X |
| 4,920,897 | 5/1990 | Reed et al. | 248/156 X |

FOREIGN PATENT DOCUMENTS

| | | | |
|---|---|---|---|
| 167716 | 2/1906 | Fed. Rep. of Germany | 248/434 |
| 282236 | 7/1952 | Switzerland | 248/434 |

*Primary Examiner*—Jose V. Chen

*Attorney, Agent, or Firm*—Larson & Taylor

[57] ABSTRACT

A garden umbrella includes a pole which can be fixed in the ground or inserted into a stand. To provide a table for supporting articles, e.g., glasses or bottles, beneath the area taken up by the opening linkage assembly for the umbrella in the folded state, the pole includes a second opening linkage assembly comprising a plurality of pivotably mounted supporting members disposed in spaced relation around the pole. The supporting members are pivotable to an opened, erected position by stays which are pivotably connected to a thrust sleeve which is mounted on the pole. In the opened position, the supporting members comprise a supporting surface for plate elements which together form the table.

6 Claims, 8 Drawing Sheets

GARDEN UMBRELLA

FIELD OF THE INVENTION

The invention relates to garden umbrellas including a solid or hollow support pole can be fixed in the ground or in a stand.

BACKGROUND OF THE INVENTION

Large-surface garden umbrellas of the type mentioned above are widely in use outdoors in gardens, on balconies and on terraces, and especially on beaches and around swimming pools during vacation time or leisure time. During such times, the summer-like temperatures which prevail lead to an increased human need and desire for the consumption of beverages. It is often a problem that bottles and glasses are placed on the ground where they can easily tip over or be knocked over. This is especially so when, in order to avoid direct sunshine, such bottles and glasses are placed in the shaded area under the garden umbrella directly adjacent to the persons who also seek the shade. A further problem is that people passing by, especially playing children, often kick sand or dirt into the glasses, which spoils the beverages. The use of portable camping tables can help to a certain degree but transporting of such a table is inconvenient and burdensome, assuming that such a table is available.

SUMMARY OF THE INVENTION

A key object of the invention is to overcome these difficulties and to provide, in connection with a garden umbrella of the aforementioned type, a mounting assembly for glasses and bottles and other articles, which, on the one hand, combat the danger of the articles tipping over or being overturned and becoming contaminated and which, on the other hand, still enables the shading effect of the garden umbrella to be utilized.

According to the invention, this object is attained through the provision, in the area occupied by the erectable linkage assembly for opening the umbrella when in the folded or closed state, of a second erectable linkage assembly including a number of supporting members disposed in spaced relation circumferentially around the pole, which, with the aid of associated stays, can be pivoted out of a closed or collapsed position in engagement against the pole into an erected position where the members extend radially outwardly around the pole so as to provide support surface for plate elements that, when supported on this support surface, together form a table of circular or polygonal shape.

Other features and advantages of the invention will be set forth in, or apparent from, the following detailed description of preferred embodiments of the invention.

BRIEF DESCRIPTION OF THE DRAWINGS

Exemplary embodiments of the garden umbrella according to the invention will be described in greater detail hereinafter in connection with the drawings, in which.

DESCRIPTION OF THE PREFERRED EMBODIMENTS

Figure 1:
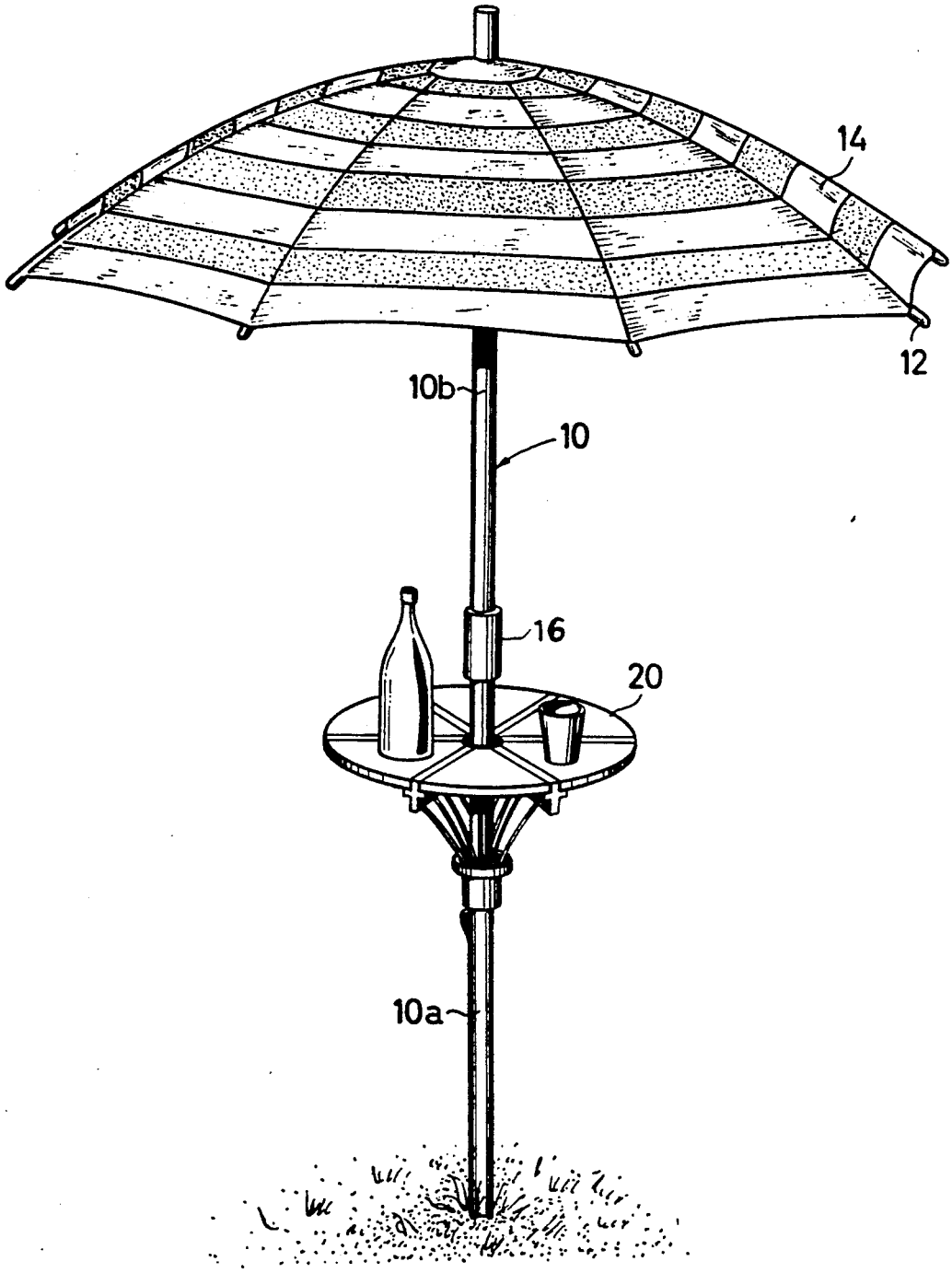
FIG. 1 is a perspective view of the garden umbrella in an erected state with the bottom end of the pole inserted into the ground (e.g., in the sand of a beach) and incorporating a table, according to the invention, concentrically surrounding the pole.

A garden umbrella is shown in FIG. 1 which includes a pole 10 with the bottom end thereof fixed in the ground, e.g., inserted into the sand on a beach, and at the top area of which is arranged, in a known manner, a conventional opening linkage assembly 12 (for the most part not visible in FIG. 1) for providing opening and closing or collapsing a suitable material forming an umbrella portion 14. Since such opening linkage assemblies for umbrellas are well known in and of themselves, no detailed representation and description of this part of the umbrella will be provided.

Figure 3:
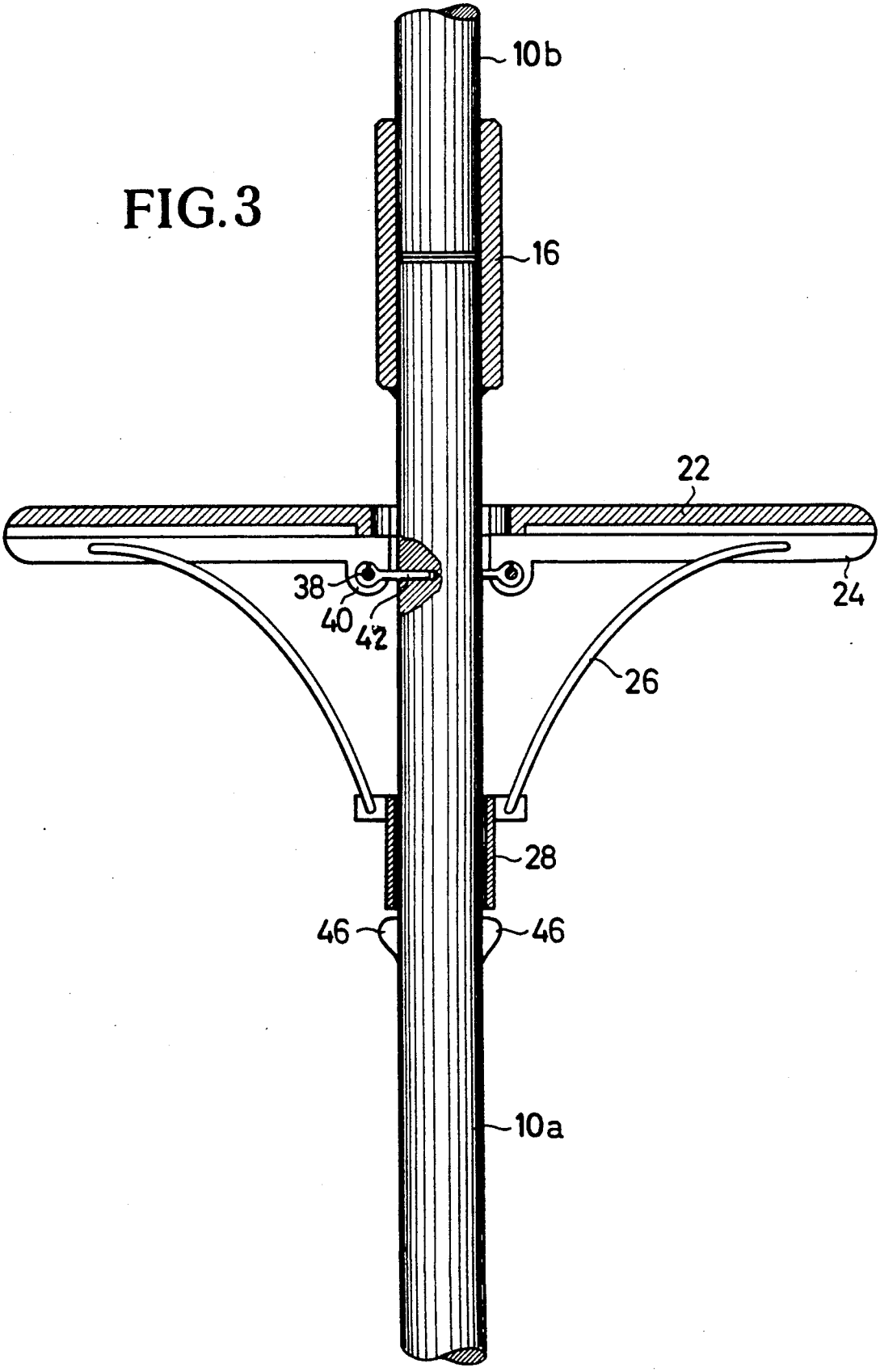
FIG. 3 is a vertical cross section through the table surrounding the pole including the opening linkage mechanism therefor, taken generally along line III—III FIG. 2.

Pole 10, in the exemplary embodiment illustrated, comprises a bottom segment 10*a* and a top segment 10*b* which are detachably connected to one another by a sleeve or sheathing member 16 (FIG. 3). The two pole segments 10*a*, 10*b* can also be connected by a locking lever mechanism, covered by sheathing member 16, which allows for oblique setting of top pole segment 10*b*, with umbrella 14 following shifting of the sheathing member, when the sun is at a low angle on the horizon. Usually, however, such a locking lever mechanism is arranged in top pole segment 10*b* and is covered by a special sheathing or covering member.

Pole 10, in the illustrated embodiment, is made of solid material, preferably wood. However, pole 10 can also be of metal or plastic tubing, and is preferably made of aluminum tubing in an alternative embodiment.

Figure 2:
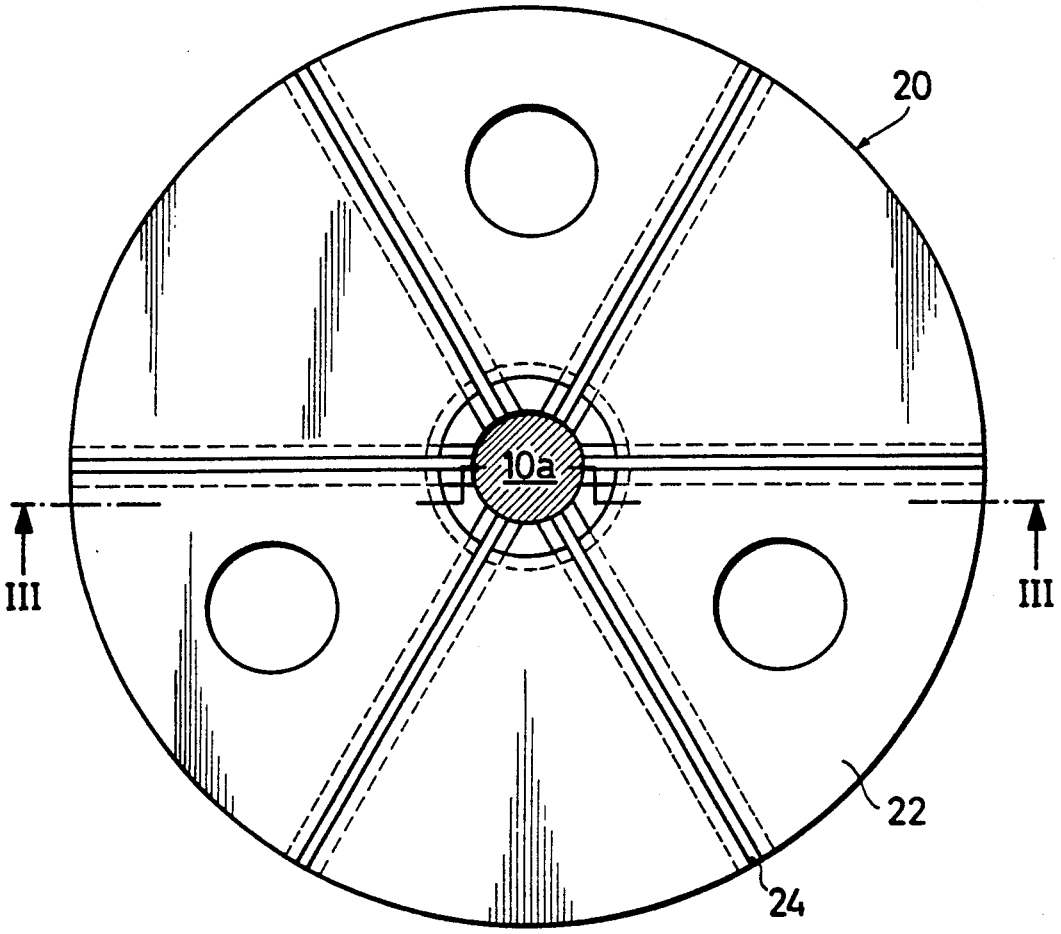
FIG. 2 is a top plan view of the table of FIG. 1 in transverse cross section, with the pole of the garden umbrella extending through the middle of the table.

As is further shown in FIG. 1 and also in FIG. 2, bottom pole segment 10*a* supports a circular table 20 which concentrically surrounds the pole. The table 20 is composed of a plurality (e.g., six in the illustrated embodiment) of sector-shaped plate elements 22 which are supported by a second opening linkage assembly to be described hereinafter in detail. The outside edges of plate elements 22, which provide corresponding the circular shape of table 20, are curved outwardly. However, these edges can also be configured as straight edges or can be curved inwardly, so that, when assembled, the table 20 has a polygonal shape.

The second opening linkage assembly comprises a plurality of supporting members or levers 24 corresponding to the number of plate elements 22, and an identical number (or double the number) of stays 26, as well as a movable sleeve or sheathing member 28 disposed on pole bottom segment 10*a*.

Figure 6:
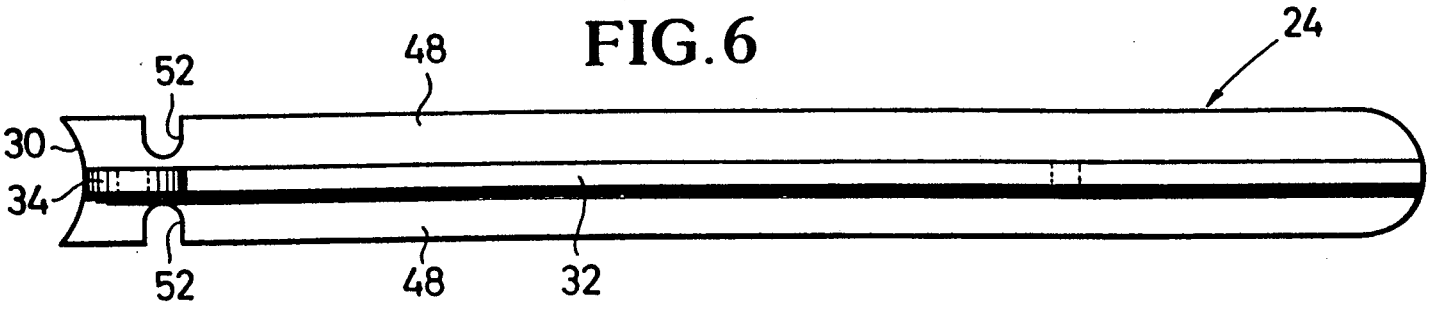
FIG. 6 is a bottom plan view of the supporting member of FIG. 5.
Figure 5:
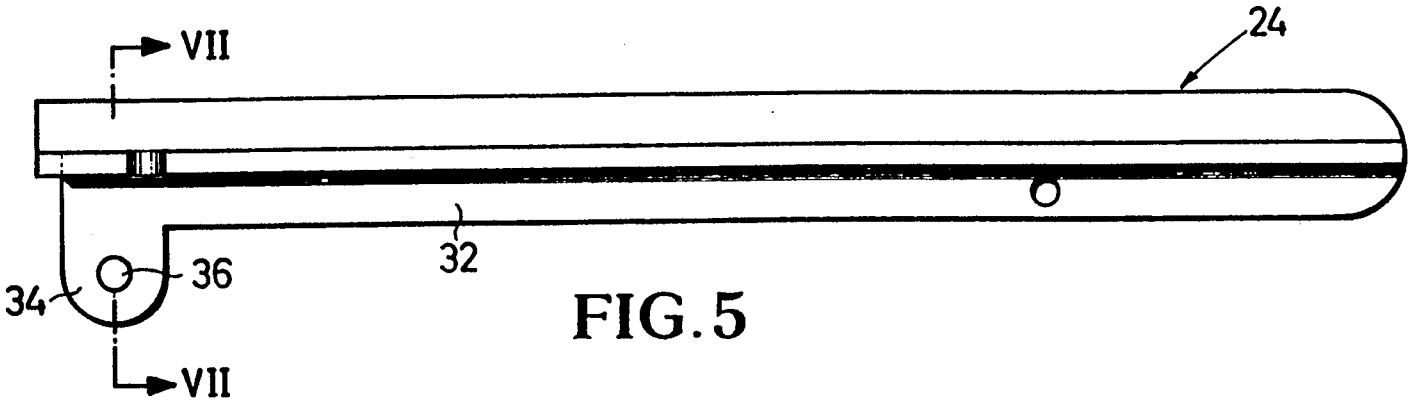
FIG. 5 is a side elevational view of a table supporting member of the opening linkage assembly for the table, shown approximately full size.
Figure 7:
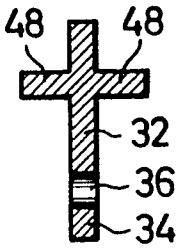
FIG. 7 is a transverse section through the supporting member taken generally along line VII—VII of FIG. 5.

As is clear from FIGS. 5 to 7, supporting levers 24 have a cross sectional profile in the shape of a cross and are recessed or channeled at the inside ends at 30 so as to conform to the cross sectional (circular) shape of bottom segment 10*a* of the pole. Support members 24 are preferably manufactured of spray-injected aluminum, but could also be made of rigid and heat-resistant plastic.

Fin-like flanges 34, with boreholes 36 therein and having the inside (inboard) ends defined or limited by the channels 30, are each formed as an extension of the bottom portion 32 of the corresponding supporting member 24. An annular mounting ring 38 extends through the boreholes 24 of supporting members 24 and is secured tightly to bottom segment 10*b* of the pole by at least two (preferably three or more) bracing eyelet members 40, disposed concentrically with respect to the bottom segment 10*a* of the pole 10. For this purpose, the eyelet members 40, the shafts 42 of which are screwed into the pole or are in some other manner fastened thereon or thereto, are advantageously slotted in the upper area, and the parts thereof then curve away from one another at the slot. This construction enables the mounting ring 38, which initially preferably has supporting members 24 mounted thereon and after this is done, is closed to form a closed ring, e.g., by welding the ends thereof together, can be received in the slots in the eyelets 40 so as to be suspended therefrom. The eyelets are then pressed together again at the ends forming the slots.

Figure 4:
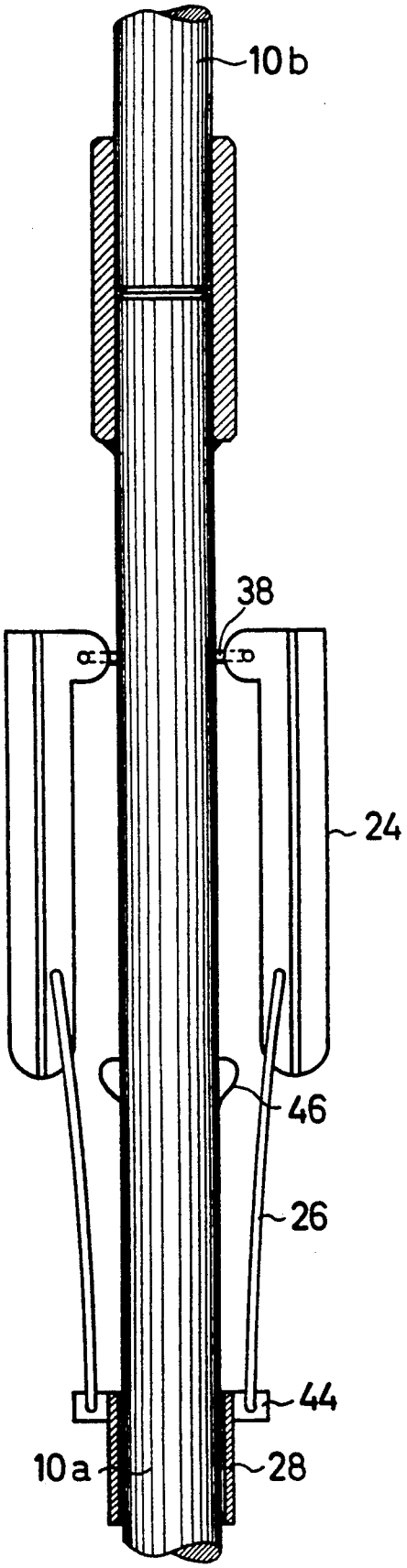
FIG. 4 is a vertical cross section similar to that shown in FIG. 3, but with the opening linkage assembly for the table shown in the folded or collapsed state thereof and with the plate elements removed.

It will be appreciated that a stationary mounting for supporting members 24 on the bottom segment 10*a* of the pole 10 is obtained by means of the construction described above, which facilitates a pivoting of supporting members 24 between the folded or closed position shown in FIG. 4 into the erected, opened position shown in FIG. 3. In the latter position, the supporting members 24 extend outwardly, with channels 30 serving as stops, i.e., the members 24 are arranged in a star-shaped arrangement and project 90 degrees radially outwardly from bottom segment 10*a* of the pole. It will be understood that instead of the mounting arrangement described above other load bearing constructions which facilitate such a folding and erecting operation could also be used.

Supporting members 24 are pivoted out of the collapsed position shown in FIG. 4 into the erected or opened out position shown in FIG. 3 and back again with the aid of, and responsive to the movement of, sheathing member or slide 28, and by means of the connecting stays or links 26 which connect sheathing member 28 with supporting members 24. For this purpose, sheathing member 28, at the top end or rim thereof, incorporates a plurality of flanges of fins 44 provided with bores in which are received the corresponding ends of stays 26. The other end of each stay 26 is mounted on or secured to the bottom portion 3 of the corresponding supporting member 24 in the vicinity of the outside end, e.g., as indicated by the unnumbered opening in portion 32 of member 24 shown in FIG. 5. This can be achieved with the aid of special bolts or other fasteners (not shown). However, these ends of the stays could also be configured, or otherwise caused to engage, bearing journals on one or both sides on the bottom portions 32 of the corresponding supporting member 24 and/or on the flanges 44 of sheathing member 28, depending on whether one or two stays 26 are being used for each supporting member 24. Finally, the stays 26 could also be provided with forked ends to enable engagement thereof with the supporting members.

In the erected or opened position, the sheathing member 28 is, as shown in FIG. 3, retained in place by at least one depressible check spring or latch member 46 provided in bottom segment 10*a* of the pole 10. It will be appreciated that this is also the customary arrangement for the locking of the top opening linkage assembly for a conventional umbrella. Such check springs or latches are advantageously arranged at such a level that only with elastic deformation of stays 26, the sheathing member 28 can be made to slide over or otherwise be brought over the latches 46, which causes a corresponding elastic or resilient bending of stays 26. Positive bracing of supporting members 24 is obtained as a result of the deflection of stays 26 caused by the loading thereon, and with the recesses or channels 30 at the ends of supporting members in firm engagement with bottom segment 10*a* of the pole 10, a corresponding bracing force is provided that results in a particularly stable and "rattle-proof" erected state.

In the erected or opened state, the side portions or laterally extending flanges of the supporting members 24 form support surfaces for the sector-shaped plate elements or plates 22. In order to prevent the plates 22 from slipping radially outward from the supporting surfaces during radial movement, plates 22 include downwardly depending flanges 50 at their inside ends which face downwardly and act as catches. In particular, the ends of flanges 50 engage in slots 52 formed in laterally extending flanges 48 of supporting members 24. Of course, the flanges or catches 50 can also be mounted at the radial outside ends of plats 22 or between the ends thereof, assuming a corresponding arrangement of slots 52 on flanges 48 of support members 24 (if slots 52 were to be formed in flanges 48 of the members 24). Instead of the flanges which form hooks or catches, short projecting members could also be provided on the longitudinal edges of the sector-shaped plates 22. However, flanges which act as catches and which extend over the entire edge of the corresponding plate 22 as described above have the advantage that such flanges reinforce the plates 22 (which are preferably made of plastic) and thus prevent the plates 22 from bending or twisting.

Figure 9:
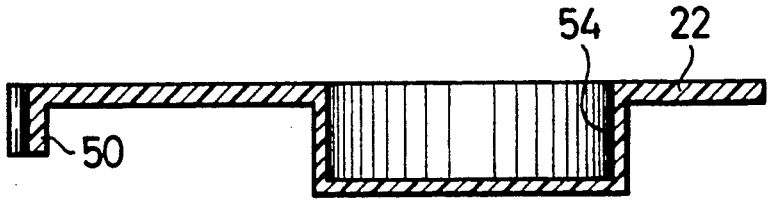
FIG. 9 is a midline longitudinal section through the plate element taken generally along line IX—IX of FIG. 8.
Figure 8:
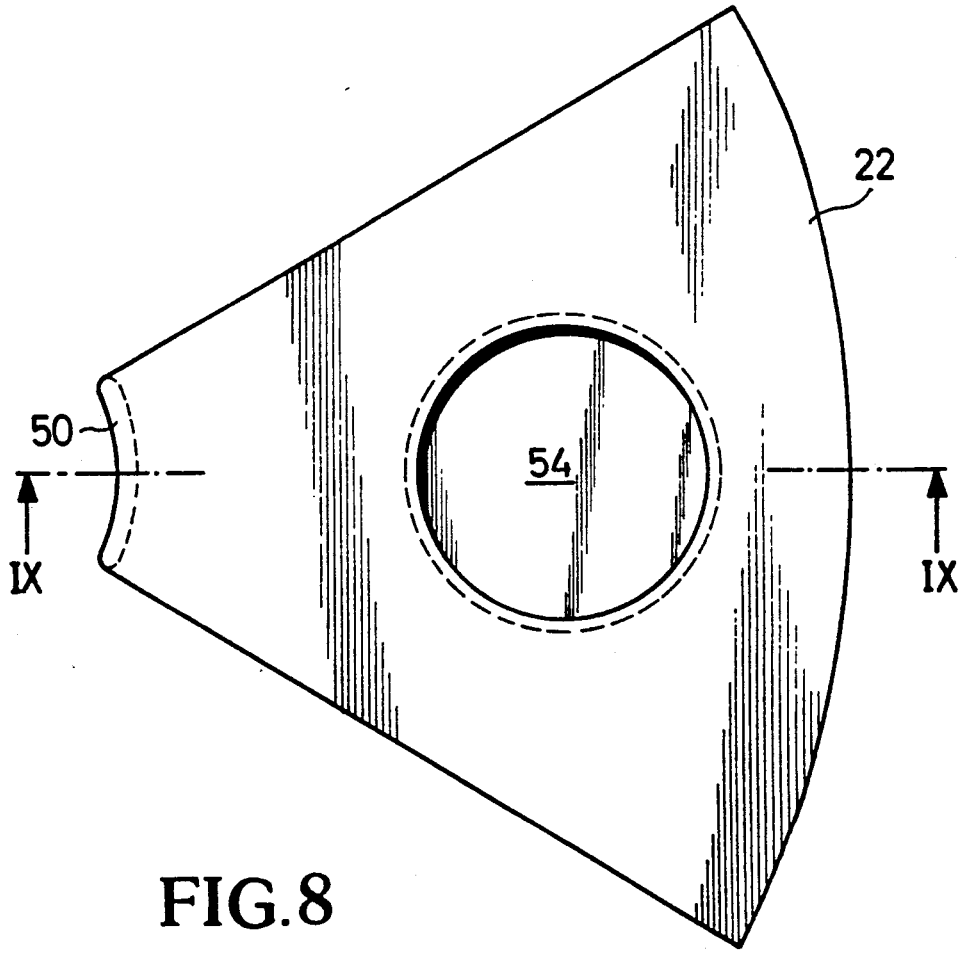
FIG. 8 is a top plan view, drawn to a smaller scale, of one plate element of the table.

It will be noted that plate elements 22 can include a smooth surface so that a flat table is formed thereby. However, because pole 10 of the garden umbrella will not always be standing directly upright and thus the table formed by plates 22 can be slightly inclined, at least some of the plates 22 advantageously incorporate recesses 54 adapted to hold glasses, bottles or other articles such as ashtrays. Further, instead of the recesses 54 as shown in FIGS. 8 and 9, circular openings or holes (not shown) could be provided in plates 22 which, for this use, would directly hold glasses and the like which would fit therein and would be engaged by slightly conically shaped walls of the openings. Further, the openings could be adapted to receive therein, basket-like holders or the like, into which would then be placed the glasses or bottles.

The table formed by the open linkage assembly comprised of elements 24, 26, 28, and the plates 22, is stable to the extent as pole 10 of the garden umbrella is also stable, whether the pole 10 is mounted in the ground or in a stand. The table can be readily and easily assembled and disassembled, with the opening linkage assembly remaining on the pole and taking up, in the folded up state, very little additional space. The plates 22 are easy to handle during assembly and disassembly and, requiring little space, can be packed for transport in a pocket or a bag. Because of their small size the plates 22 are also easy to clean following use and disassembly and can simply be cleaned in a rinsing basin or the like.

In the case of a two-part pole such as is illustrated in the drawings, the bottom segment 10*a* of the pole with the table attached thereto can, of course, also be used without the top segment 10*b* of the pole 10 with the umbrella portion 14. Also, the bottom segment 10*a* of the pole 10 with the assoc manufactured separately and can, similarly, be manufactured and marketed by some other manufacturer as accessory for the garden umbrella, or even as a table alone.

Figure 10:
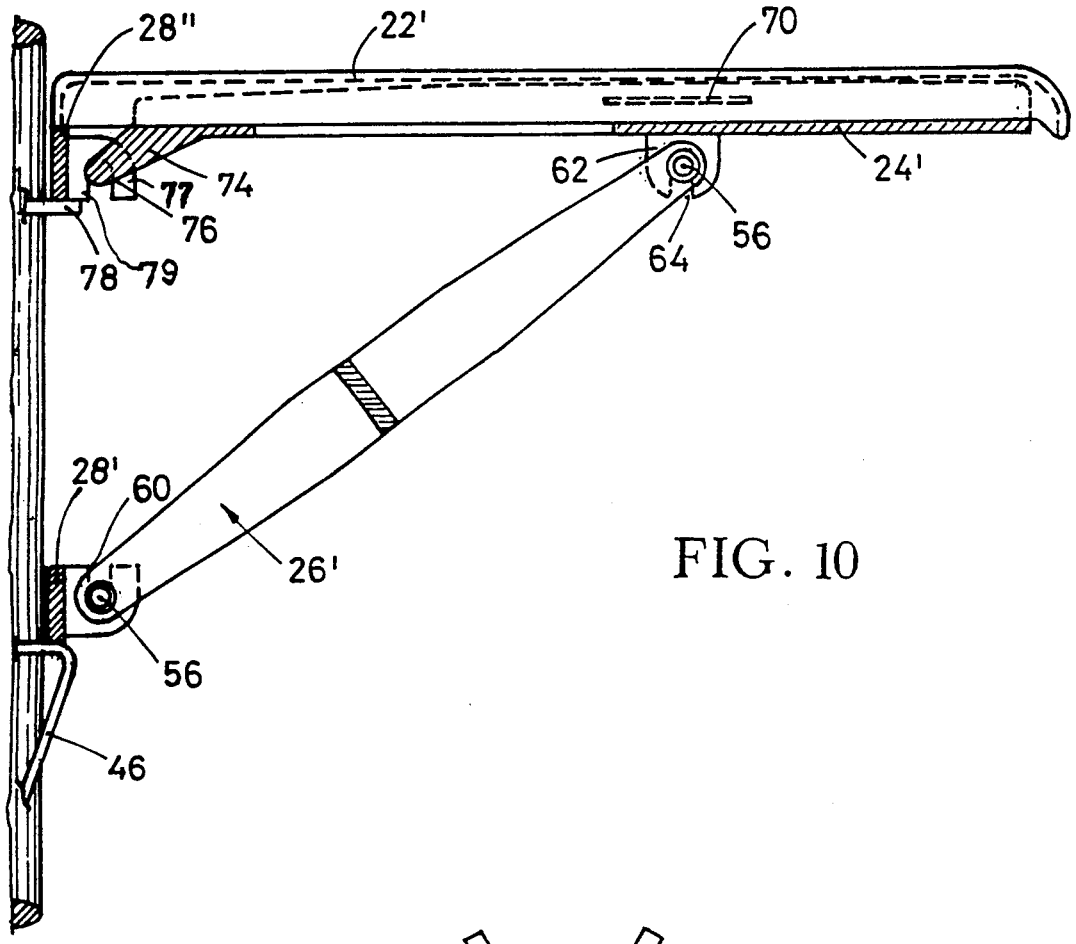
FIG. 10 is a vertical cross section through a further exemplary embodiment of the invention, similar to the cross section in FIG. 3.
Figure 11:
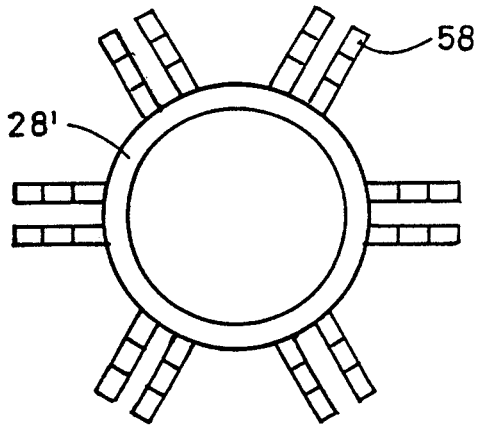
FIG. 11 is a top plan view of a sheathing or sleeve member for the opening linkage mechanism of FIG. 10.
Figure 12:
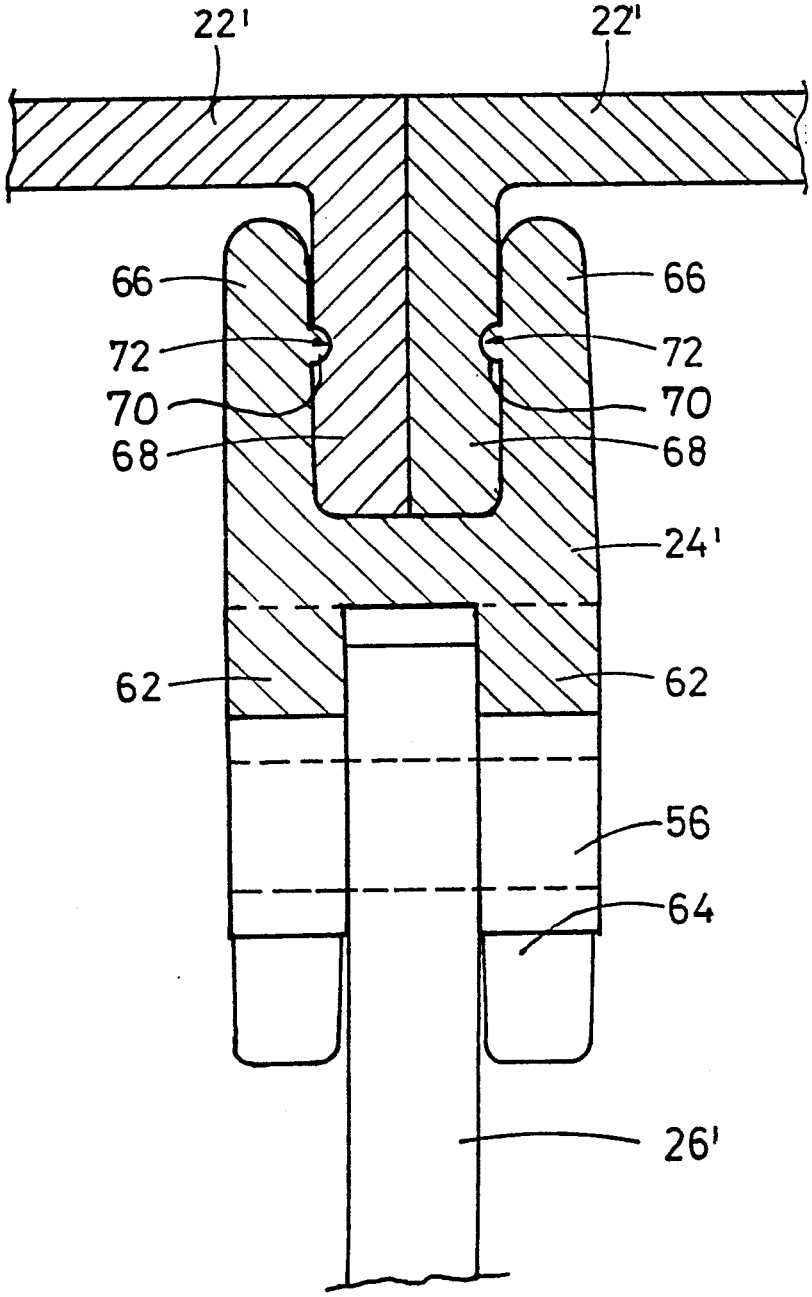
FIG. 12 is a transverse section through a table supporting member which is a part of the opening linkage assembly of FIG. 10.

A further embodiment of the invention is shown in FIGS. 10 to 12. This embodiment differs from the first exemplary embodiment in that the stays or brace members 26', which are preferably made of plastic, are configured to be very rigid in the direction of the loading thereon and are supported at both ends by journals 56 provided at these ends.

The sleeve or sheathing member 28', which is to be moved axially along the pole to provide erecting or opening out of the table mechanism, comprises, as shown in FIG. 11, a plurality of fin-like projecting members 58 which extend radially outwardly, which are arranged in pairs, and which include slotted bearing openings formed therein that face upward and terminate in generally circular bearing surfaces or bearing boreholes in which are fitted the journals 56 of stays 26'. The slot openings, which are indicated at 60 and which lead to or open into the bearing boreholes, are somewhat narrower in width than the borehole diameter, so that journals 56 can be snapped into the bearing boreholes of projecting support members 58 of sleeve or sheathing member 28'.

The pivot (articulation) connection between the other end of stays 26' and the supporting members 24' is configured in a similar manner to the pivot (articulation) connection between stays 26' and sleeve or sheathing 28'. At the point where the pivot connection is located, support members 24' are provided with fin-like projections or flanges 62 which are arranged in pairs, extend parallel to one another, and include bearing boreholes or bearing surfaces that open upwardly. Again, the slot opening, denoted 64, of these bearing surfaces is somewhat narrower than the diameter of the bearing borehole itself, so that the journals 56 which extend to both sides at the top ends of stays 26' can be snapped into the bearing boreholes which have been adapted to receive them.

Supporting members 24' of the embodiment of FIGS. 10 to 12 have an essentially U-shaped cross section as shown in FIG. 12, including upright arms indicated at 66 in FIG. 12.

In the embodiment of FIGS. 10 to 12, the pie or sector shaped plate elements or plates 22' include lateral flanges 68 which are bent downwardly and abut against each other as illustrated in FIG. 12. These lateral flanges 68 also engage supporting levers 24'. The arrangement shown in FIG. 12 is such that two facing and abutting lateral flanges 68 of adjacent plate elements 22' fit between the arms 66 of a supporting member 24'. In order to securely hold plate elements 22' in place, the lateral flanges 68 of these plates are provided, in turn, in a middle area on the inside wall thereof, with a recess or groove 70 extending thereby a predetermined length, into which can be snapped respective projections or ribs 72 provided on the inside walls of arms 66 of supporting members 24'. The detachable snap connection formed by elements 70, and 72, which can be detached or disconnected with the application of a suitable limited force, assures proper positioning of plate elements 22' on supporting levers 24' in both perpendicular and horizontal directions.

Articulated mounting of supporting member 24' on the pole is provided in the embodiment of FIGS. 10 to 12 in the same manner as the articulated mounting of stays 26' on the pole. In this regard, a second sheathing member or sleeve 28'' (FIG. 10) is preferably provided which is identical in shape and dimensions to sheathing member or sleeve 28'. The inside ends of supporting members 24' are provided with extensions 74 which project obliquely downwardly and inwardly, and which similarly include journals 76 received in bearings in a manner corresponding to journals 56.

The top sheathing member or sleeve 28'' is mounted in reversed relation to the mounting of bottom sheathing member 28' so that the bearing surfaces or boreholes 77 in fin-like projections 79, which are provided on members 24' and into which journals 76 can be snapped, open downwardly. As shown in FIG. 10, the height and shape of sleeve or sheathing member 28'', and of the plate elements 22', are selected so that the radially inside ends of the plate elements 24' engage sheathing member 28'' and thus are also supported thereon.

Sheathing member 28'' rests on and is supported by a pin 78 received in a transverse bore in pole 10. This pin 78 could also extend through a transverse bore in sheathing member 28'' so that the sheathing member would be held tightly in axial alignment with the pole. In the same manner, bottom sheathing member 28' can also be loosely supported on pole 10 or can be secured tightly thereto. Following the withdrawal of pin or pins 78, the opening linkage mechanism of pole 10 can be removed.

What is claimed is:

1. A garden umbrella including a plurality of removable plate elements, an umbrella canopy which is movable by a opening linkage assembly between a collapsed, closed state and an erected, open state, and a pole which can be fixed in the ground or inserted into a stand, said umbrella comprising, disposed beneath the area occupied by the opening linkage assembly in the closed state of the umbrella canopy, a second opening linkage assembly comprising a plurality of supporting members disposed in a spaced relation around the pole and having innermost and outermost ends and means, including support stays connected to the support members, for providing pivoting of said members from a folded position in engagement with the pole and an erected position wherein the support members extend radially outwardly relative to the pole so as to positively engage and support said plate elements so that the plate elements, as supported by said supporting members, constitute a table; said umbrella further comprising a sleeve mounted on said pole so as to be slidable therealong and said stays being pivotably connected at the upper ends thereof to the supporting members and at the lower ends thereof to said sleeve, said umbrella further comprising retaining means for retaining the second opening linkage assembly in a state wherein said supporting members are in the erected position thereof, a further sleeve being mounted on said pole and connected to the innermost ends of said support members.

2. A garden umbrella as claimed in claim 1, further comprising a sleeve mounted on the pole and connected to the innermost ends of the supporting members to provide support for said supporting members, said plate elements having innermost ends and being engaged at the innermost ends thereof with said sleeve connected to the supporting members.

3. A garden umbrella as claimed in claim 1, wherein the plate elements including downwardly extending lateral flanges and the supporting members are of a substantially U-shaped upwardly opening cross section and each receives therein the downwardly extending lateral flanges of adjacent plate elements.

4. A garden umbrella as claimed in claim 1, wherein said supporting members include laterally projecting bearing journals at the innermost ends thereof received in corresponding bearing boreholes in one of the sleeves and wherein the stays include laterally projecting bearing journals at both ends thereof received in corresponding bearing boreholes in one of the sleeves and the supporting members.

5. A garden umbrella as claimed in claim 1, wherein the plate elements include recesses or apertures therein for receiving glasses or bottles, or inserts for holding such glasses or bottles.

6. A garden umbrella as claimed in claim 1 wherein the sleeve which is pivotably connected to the stays has the same shape as said further sleeve.

* * * * *